US006396936B1

(12) United States Patent
Nevill

(10) Patent No.: US 6,396,936 B1
(45) Date of Patent: May 28, 2002

(54) AUXILIARY BASS RADIATOR UNITS

(75) Inventor: Stuart Michael Nevill, Kent (GB)

(73) Assignee: B&W Loudspeaker Limited, Worthing (GB)

( * ) Notice: Subject to any disclaimer, the term of this patent is extended or adjusted under 35 U.S.C. 154(b) by 0 days.

(21) Appl. No.: 09/582,502

(22) PCT Filed: Nov. 10, 1999

(86) PCT No.: PCT/GB99/03752

§ 371 (c)(1),
(2), (4) Date: Jun. 27, 2000

(87) PCT Pub. No.: WO00/32010

PCT Pub. Date: Jun. 2, 2000

(30) Foreign Application Priority Data

Nov. 24, 1998 (GB) ..... 9825753

(51) Int. Cl.[7] ..... H04R 25/00

(52) U.S. Cl. ..... 381/349; 181/156; 181/171; 381/398

(58) Field of Search ..... 381/349, 398, 381/404, 423; 181/156, 171, 172, 173, 174

(56) References Cited

U.S. PATENT DOCUMENTS 5,749,433 A * 5/1998 Jackson ..... 181/156
6,176,345 B1 * 1/2001 Perkins et al. ..... 181/173

FOREIGN PATENT DOCUMENTS

| | | | |
|---|---|---|---|
| DE | 3743146 | A1 | 6/1989 |
| DE | 3915204 | A1 | 11/1990 |
| DE | 4033082 | A1 | 4/1992 |
| EP | 0 492 914 | A2 | 7/1992 |
| GB | 806327 | | 12/1958 |
| GB | 1070186 | | 6/1967 |

* cited by examiner

*Primary Examiner*—Sinh Tran
(74) *Attorney, Agent, or Firm*—Burns, Doane, Swecker & Mathis, L.L.P.

(57) ABSTRACT

An auxiliary bass radiator unit is disclosed for mounting in an aperture in a loudspeaker enclosure. The unit comprises a substantially rigid panel member (10) mounted on a flexable surround member (12) so as to allow the panel member, when mounted, in use, in the aperture to move in sympathy with sound waves within the enclosure. The flexable surround member includes a hinge portion (14) mounting the panel member for movement as a hinged flap. Thus, movement of the panel member in twisting and other undesirable modes is substantially avoided.

22 Claims, 5 Drawing Sheets

AUXILIARY BASS RADIATOR UNITS

This invention relates to auxiliary bass radiator units. That is to say, units which when installed in a loudspeaker enclosure form an auxiliary bass radiator.

Auxiliary bass radiators (ABRs) have been known for many years and are used to take the place of tuning ports in bass reflex loudspeaker enclosures.

A bass reflex loudspeaker enclosure, which is a fourth order acoustic system, has the bass output augmented by the Helmholtz resonance that occurs when the mass of the air in a tuning port resonates on the stiffness of the air inside the box. Generally, if such a system is designed properly, about half an octave of extra bass extension may be achieved by this means. The roll off rate for a fourth order, bass reflex. system is 24 dB per octave below the resonance frequency. For a closed loudspeaker enclosure with no tuning port, the rate is 12 dB per octave.

ABRs were devised to allow low frequency Helmholtz tunings to be achieved when physically small loudspeaker enclosures were needed. In such cases, the length of a non-ABR tuning port would be too long to be accommodated in the enclosure and would have troublesome pipe resonances of its own. An equivalent resonance frequency can, however, be achieved by replacing the mass of air in the tuning port with a solid mass on a separate suspension. Such an arrangement is effectively a loudspeaker diaphragm without either voice coil or magnet. By choosing the mass to match the diaphragm area and size of the enclosure, this mass spring resonator may be tuned to virtually any frequency desired in practice without the problems of length from which tuning ports suffered.

Usually, the free air resonance frequency of an ABR is made as low as possible and then, when it is placed in the enclosure, the stiffness of the air in the enclosure takes over as the major stiffness tuning factor. The combination of an ABR and enclosure has a response very similar to that which would have been achieved with a non-ABR tuning port.

If, however, the free air resonance is made too high, a dip occurs in the output of the system at the free air resonance frequency and the bass roll off rate is steeper above this free air resonance dip.

It is an object of the invention to provide an improved auxiliary bass radiator unit.

The present invention provides an auxiliary bass radiator unit for mounting in an aperture in a loudspeaker enclosure, the unit comprising a substantially rigid panel member mounted on a flexible surround member so as to allow the panel member, when mounted, in use, in the said aperture, to move in sympathy with sound waves within the enclosure, wherein the panel member is constrained to move as a hinged flap.

The invention is based on the realization that because ABRs had to be made to allow a long throw, that is a large movement back and forth, to occur at the mass spring or Helmholtz equivalent resonance frequency, they unfortunately allowed the ABR panel member to move in other modes than simply back and forth. For example, rocking and twisting modes were not prevented from occurring by the necessarily floppy suspension. These higher order modes coloured the resulting sound output from the speaker system.

In the construction according to the invention, the said higher order modes are substantially suppressed. The constraint substantially prevents rocking, twisting and other undesirable modes of vibration from occurring.

Advantageously, a hinge portion is included within the flexible surround member and mounts the panel member for movement as a hinged flap. Such a construction provides a simple way of constraining the movement of the panel member.

Advantageously, the outer periphery of the surround member is connected to a substantially rigid frame member for mounting the flexible surround member in the said aperture. Such a construction facilitates the mounting of the periphery of the surround member in the said aperture.

Preferably, the frame member includes a sealing bead of resilient material to seal the frame member in the said aperture. By this means, a good seal between the frame member and the aperture can readily be achieved.

Advantageously, the panel member includes a substantially straight side along at least part of which the hinge portion is provided. Such a construction is particularly simple.

The hinge portion may be defined by an integral part of the surround member. In particular, the hinge portion may comprise a flat web portion of the surround member.

Advantageously, the web portion is connected to an edge portion of the panel member and to a corresponding edge portion of the frame member and further includes an integral spur extending the flat web portion into a T-shaped cross-section, the spur being located between the edge of the panel member and the edge of the frame member. Such a construction provides a particularly effective form of hinge.

At locations other than in the hinge portion, the surround member may comprise a roll portion. The roll portion provides a simple means of mounting the free edges of the panel member.

Preferably, the roll portion tapers towards the hinge portion. By that means, greater movement at distances remote from the hinge portion is readily accommodated.

The roll portion may be of semi-circular cross-section.

Advantageously, the roll portion includes transverse ribs. By this means, any tendency of the surround member to pucker can be reduced.

Preferably, the ribs are formed by corrugations in the material of the surround member.

The panel member may have a plurality of substantially straight sides along one of which the hinged portion is provided.

The ribs may be provided at one or more corners, remote from the hinged portion, where two straight sides meet.

Advantageously, the said one or more corners are rounded. By this means also, any tendency to puckering can be reduced.

The panel member may be substantially rectangular with rounded corners at its end opposite to the hinged portion.

A short side of the rectangular panel member may have the hinged mounting.

The surround member may be made of resilient polymeric material, for example, a natural or synthetic rubber material.

The panel member may be made of plastics material, for example, polypropylene.

The frame member may be made of plastics material, for example, polypropylene.

The unit may be made by the co-injection moulding of component parts.

The panel member, when at rest, may be set back substantially from the surface of the frame member.

The panel member may have a thickness of at least 3 millimetres, or of at least 4 millimetres, or of at least 5 millimetres, or a thickness of between 4 and 10 millimetres. Such dimensions enable the panel member to have sufficient mass and stiffness to be used without the addition of a supplementary weighting or stiffening means.

The invention also provides a loudspeaker enclosure including an auxiliary bass radiator unit according to the invention.

Two such units may be provided on opposite sides of the enclosure. By this means, the physical stability of the enclosure when in use is improved.

The invention also provides a loudspeaker system comprising an enclosure as defined above and one or more loudspeaker drive units.

An auxiliary bass radiator unit constructed in accordance with the invention will now be described, by way of example only, with reference to the accompanying drawings, in which.

Figure 1:
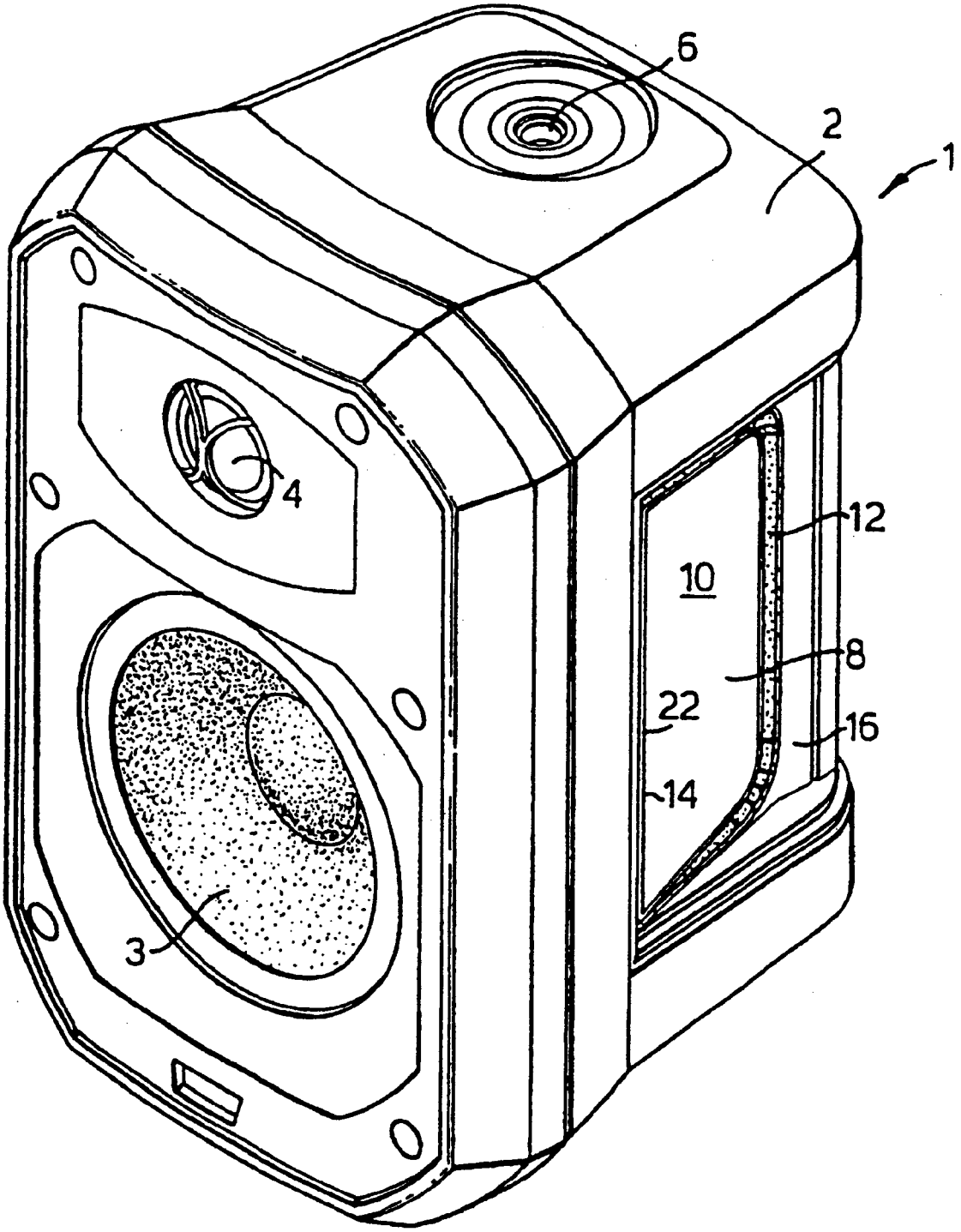
FIG. 1 is a perspective view of a loudspeaker enclosure including two such auxiliary bass radiator units.
Figure 2:
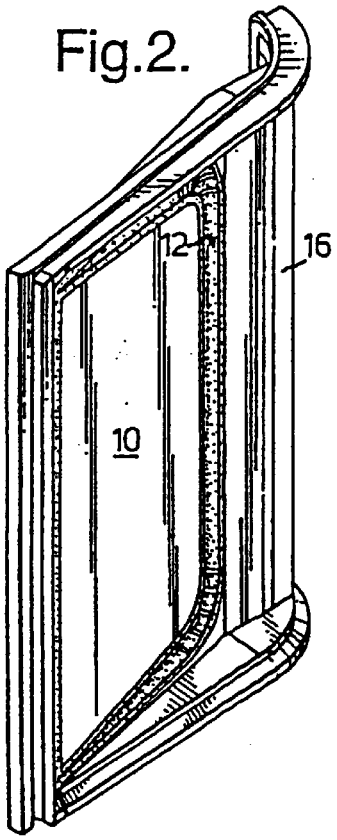
FIG. 2 is a perspective view of the auxiliary bass radiator unit.
Figure 5:
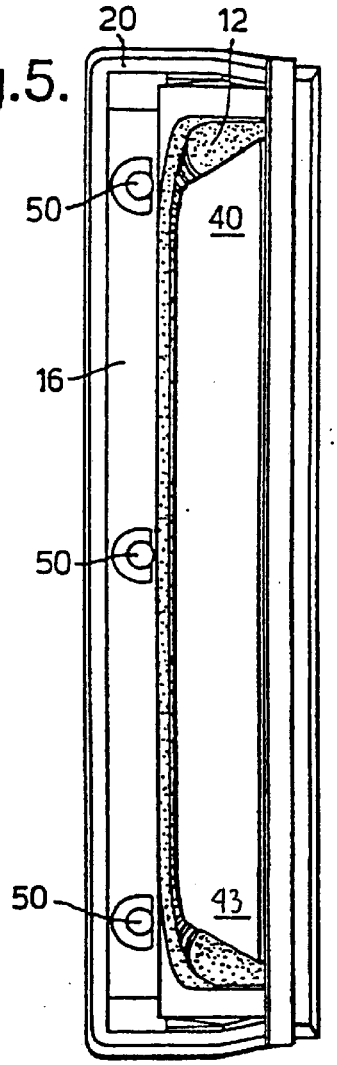
FIG. 5 is a view seen in the direction of the arrow V marked in FIG. 4.

Referring to the accompanying drawings, FIG. 1 shows a loudspeaker system 1 comprising an enclosure 2, a bass and lower mid-range loudspeaker drive unit 3, a high-frequency loudspeaker drive unit 4, an upper mid-range loudspeaker drive units 6, and two auxiliary bass radiator units of which only one, 8, is seen in the drawing. The other auxiliary bass radiator unit (not shown) is constructed and arranged as a mirror image of the unit 8 on the side of the enclosure 2 not visible in the drawing.

Each auxiliary bass radiator unit is mounted in an aperture in the loudspeaker enclosure 1 and comprises a substantially rigid panel member 10 mounted on a flexible surround member 12 so as to allow the panel member to move in sympathy with sound waves within the enclosure. The panel member 10 is made of plastics material, preferably polypropylene.

The flexible surround member 12 includes a hinge portion 14 mounting the panel member 10 for movement as a hinged flap. The surround member 12 is made of resilient polymeric material, preferably, synthetic rubber material.

The outer periphery of the surround member 12 is connected to a substantially rigid frame member 16 for mounting the flexible surround member in the enclosure 1. The frame member 16 is made of plastics material, preferably, polypropylene.

The frame member 16 includes a sealing bead 20 of resilient material to seal the frame member in the said aperture.

The panel member 10 includes a substantially straight side 22 along which the hinge portion 14 is provided.

As can be seen in the drawings, the panel member 10 is substantially rectangular with rounded corners 40 and 43 at its end opposite to the hinged portion 14, a short side (22) of the rectangular panel having the hinged mounting.

The hinge portion 14 is defined by an integral part of the surround member and comprises a flat web portion 24 of the surround member. The web portion 24 is connected to a reduced thickness edge portion 26 of the panel member 10 and to a corresponding reduced thickness edge portion 28 of the frame member 16. The web portion 24 further includes an integral spur 30 extending the flat web portion into a T-shaped cross-section, the spur being located between the edge portion 26 of the panel member 10 and the edge portion 28 of the frame member 16.

At locations other than in the hinge portion 14, the surround member 12 comprises a roll portion 32. The roll portion 32 tapers towards the hinge portion and the roll is of semi-circular form and includes transverse ribs 34 and lip portions 36 and 38. The lip portions 36 and 38 are connected to the panel member 10 and the frame member 16 respectively.

The ribs 34 are formed by corrugations in the material of the surround member 12 and are provided at corners 40 and 42, remote from the hinged portion 14.

The unit is made by co-injection moulding of the component parts 10 (panel member), 12 (surround member) and 16 (frame member). As can be seen in FIG. 1, the panel member 10, when at rest, is set back substantially from the surface of the frame member Three mounting eyes 50 are provided, each to receive a respective mounting screw (not shown).

Thus, each auxiliary bass radiator 8 has a hinge along one edge and so defines a flap that can move back and forth. This construction prevents many of the troublesome upper frequency resonances which tended to occur in a conventional "freely floating" auxiliary bass radiator.

The completely floppy surround conventionally used is here replaced with a hinge along one side of the auxiliary bass radiator panel member. The panel member has at least one straight edge to facilitate the operation of the hinge but the rest of the panel member may be of virtually any shape. The surround member is arranged to allow increasing movement as distance from the hinged edge increases. Thus, instead of an in-out piston like motion occurring, the present hinged construction remains effectively stationary at the hinged edge and, at any given frequency, the movement in and out in a flapping motion increases linearly as distance from the hinge increases.

The fundamental frequency of the present hinged auxiliary bass radiators can be altered in the same way as with any other auxiliary bass radiator by changing the mass per unit area or the stiffness of the surround. As usual the free air resonance of the auxiliary bass resonator will usually be made as low as possible to avoid a dip in the frequency response resulting from the free air resonance of the auxiliary bass radiator resonating on its own suspension.

The panel member itself is very stiff and well-damped to avoid panel resonances occurring within the panel member itself. Rocking and twisting modes are largely prevented by the hinge mechanism.

As an example only, some preferred dimensions will now be given.

Figure 3:
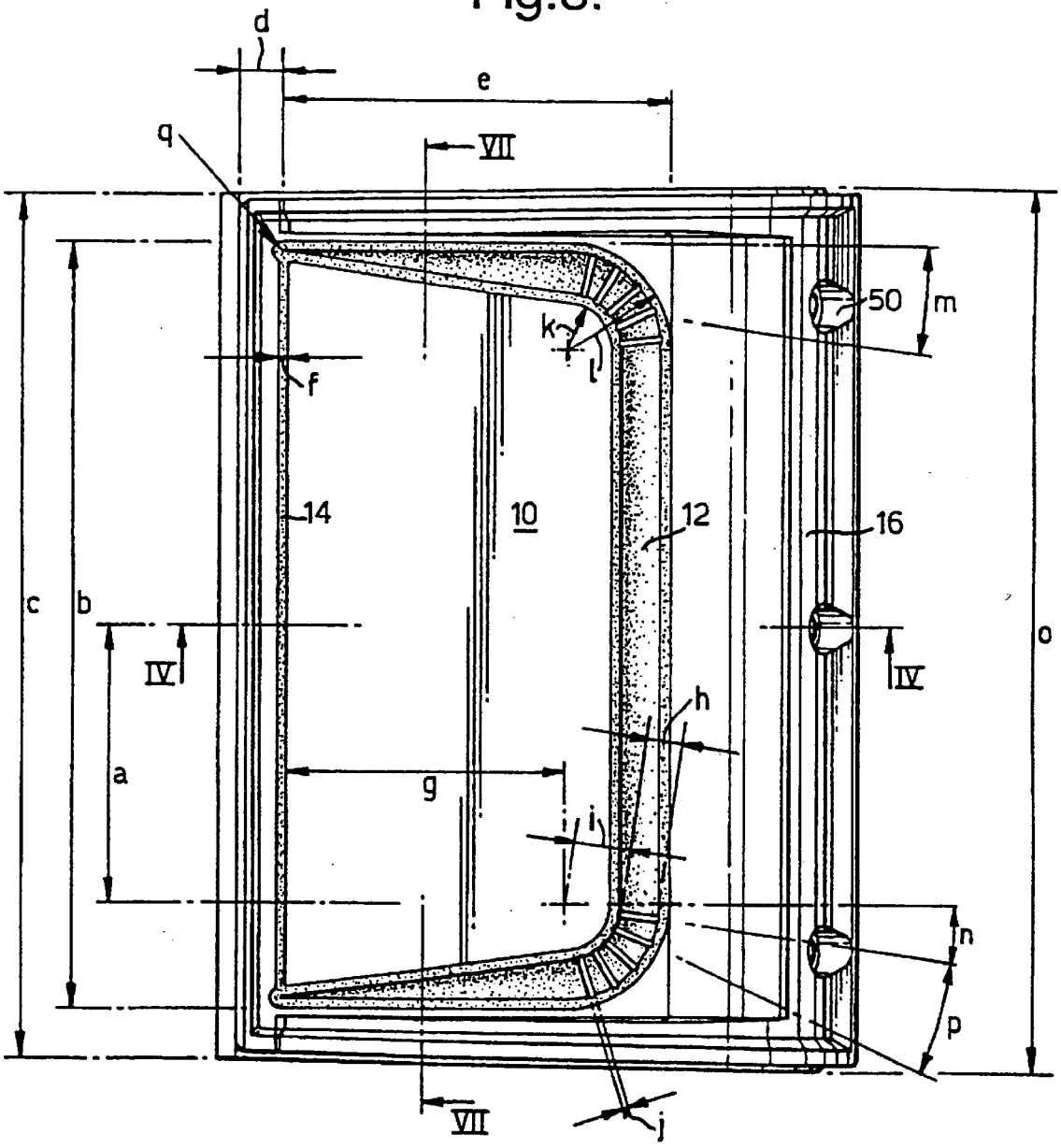
FIG. 3 is an elevational view of the auxiliary bass radiator unit.

The following table gives the dimensions in millimetres of lengths marked in FIG. 3:

| | |
|---|---|
| a | 47.2 |
| b | 130.0 |
| c | 145.9 |
| d | 7.3 |
| e | 67.5 |
| f | 0.75 |
| g | 49.4 |

-continued

| | |
|---|---|
| h | 6.2 |
| i | 9.9 |
| j | 1.0 |

The following table gives the radius in millimetres of curves marked in FIG. 3:

| | |
|---|---|
| k | 8.0 |
| q | 1.8 |
| l | 18.0 |

The following table gives the magnitude in degrees of angles marked in FIG. 3:

| | |
|---|---|
| m | 7.2 |
| n | 8.5 |
| o | 2.0 |
| p | 16.0 |

Figure 4:
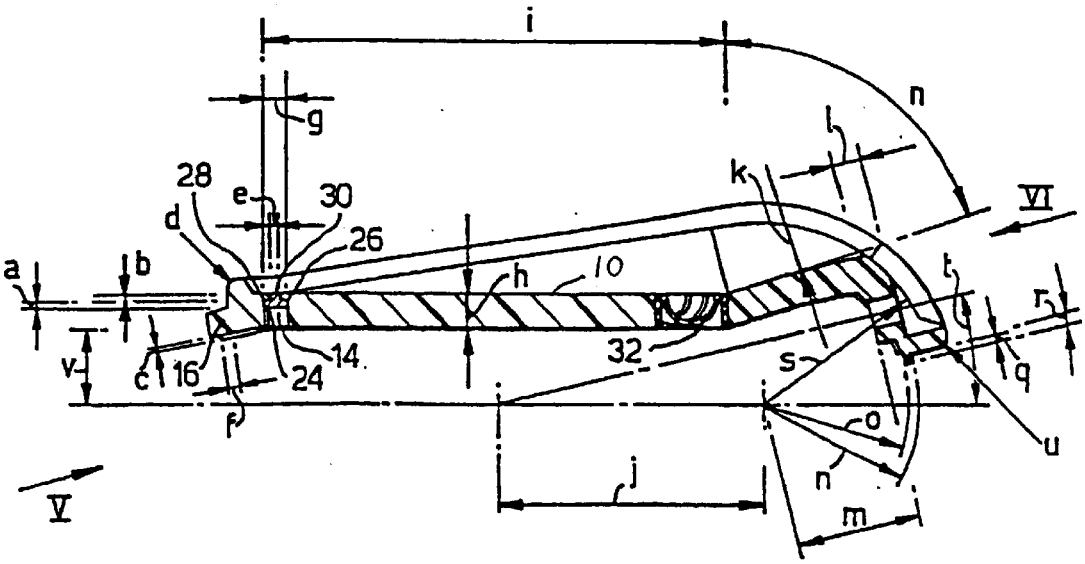
FIG. 4 is a cross-sectional view taken on the line IV—IV marked in FIG. 3.

The following table gives the dimensions in millimetres of lengths marked in FIG. 4:

| | |
|---|---|
| a | 1.0 |
| b | 1.0 |
| c | 0.5 |
| e | 1.5 |
| f | 2.0 |
| g | 3.6 |
| h | 5.0 |
| i | 68.5 |
| j | 39.4 |
| l | 4.0 |
| m | 18.0 |
| q | 6.0 |
| v | 0.9 |

The following table gives the radius in millimetres of curves marked in FIG. 4:

| | |
|---|---|
| d | 1.5 |
| k | 25 |
| o | 21.0 |
| p | 22.4 |
| s | 25.7 |
| u | 1.5 |

The following table gives the magnitude in degrees of angles marked in FIG. 4:

| | |
|---|---|
| n | 72.3 |
| r | 3.0 |
| t | 13.0 |

Figure 6:
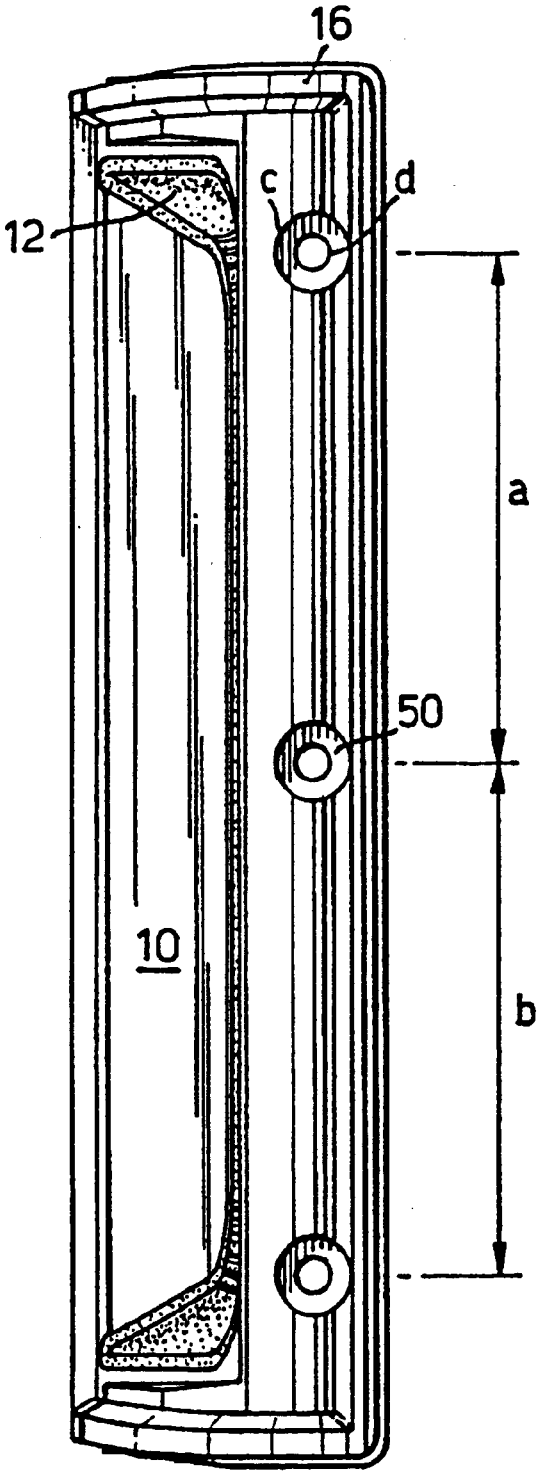
FIG. 6 is a view seen in the direction of the arrow VI marked in FIG. 4.

The following table gives the dimensions in millimetres of lengths marked in FIG. 6:

| | |
|---|---|
| a | 55.0 |
| b | 55.0 |

The following table gives the diameter in millimetres of circles marked in FIG. 6:

| | |
|---|---|
| c | 8.5 |
| d | 4.1 |

Figure 7:
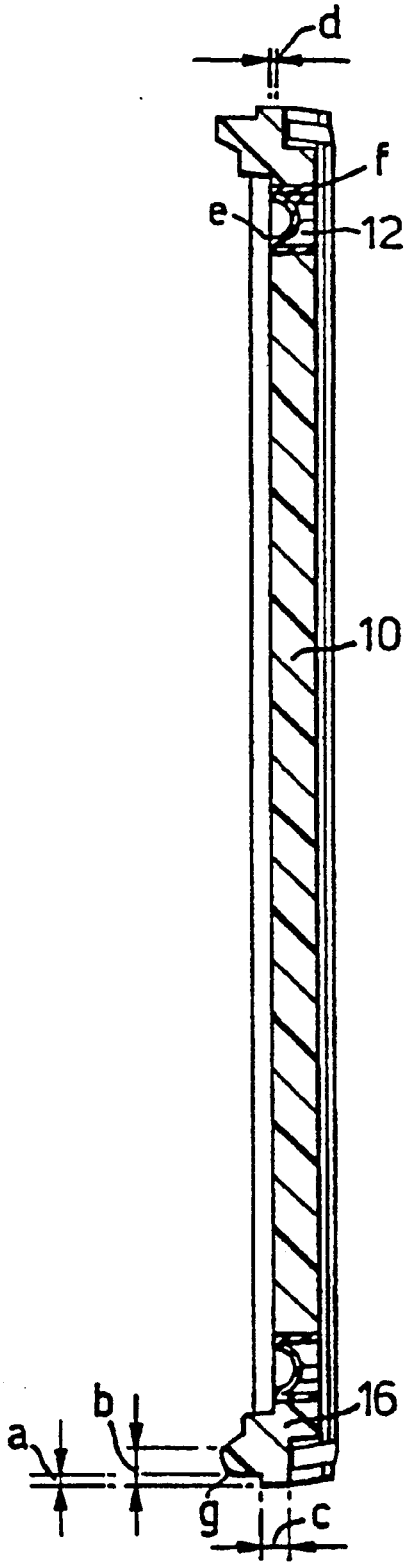
FIG. 7 is a cross-sectional view taken on the line VII—VII marked in FIG. 3.

The following table gives the dimensions in millimetres of lengths marked in FIG. 7:

| | |
|---|---|
| a | 1.1 |
| b | 2.4 |
| c | 2.9 |
| d | 0.5 |

The following table gives the radius in millimetres of curves marked in FIG. 7:

| | |
|---|---|
| e | 0.25 |
| f | 2.3 |
| g | 1.5 |

Figure 8:
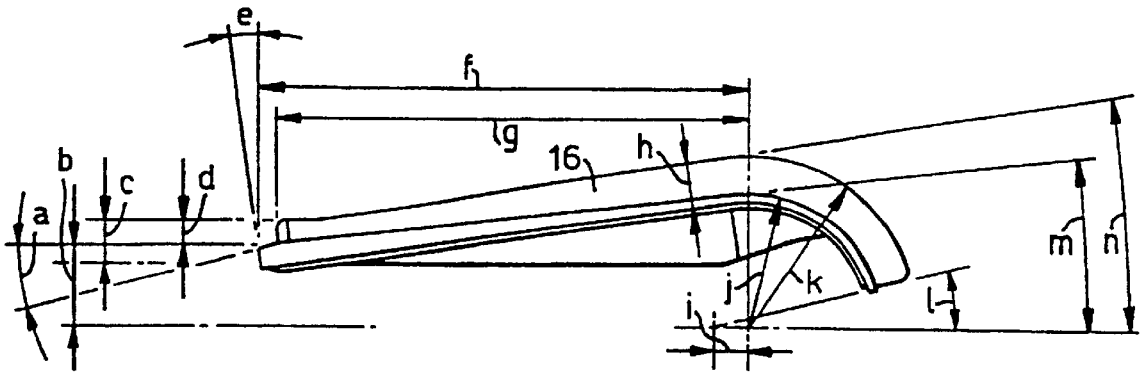
FIG. 8 is a side elevation corresponding to FIG. 4.

The following table gives the dimensions in millimetres of lengths marked in FIG. 8:

| | |
|---|---|
| b | 10.9 |
| c | 7.3 |
| d | 4.3 |
| f | 83.2 |
| g | 80.1 |
| h | 7.6 |
| i | 6.0 |

The following table gives the radius in millimetres of curves marked in FIG. 8:

| | |
|---|---|
| j | 22.4 |
| k | 28.7 |

The following table gives the magnitude in degrees of angles marked in FIG. 8:

| | |
|---|---|
| a | 14.5 |
| e | 8.0 |
| l | 14.5 |
| m | 6.1 |
| n | 8.4 |

Figure 9:
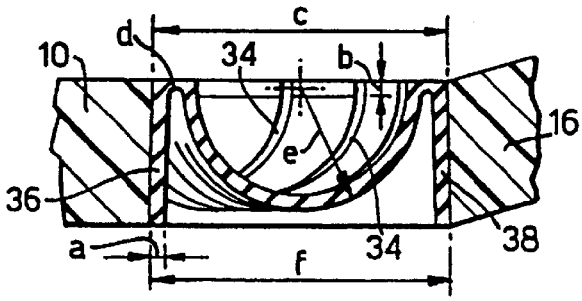
FIG. 9 is a detail view to an enlarged scale of a part of FIG. 4.

The following table gives the dimensions in millimetres of lengths marked in FIG. 9:

| | |
|---|---|
| a | 0.5 |
| b | 0.5 |
| c | 10.0 |

The following table gives the radius in millimetres of curves marked in FIG. 9:

| | |
|---|---|
| d | 0.25 |
| e | 4.01 |

The angle f marked in FIG. 9 is 3.0 degrees.

Many different variations of the illustrated construction are possible without departing from the scope of the invention defined by the appended claims. For example, the panel member can have a weight attached to it to increase its mass and, provided that it mounted to move as a hinged flap can have virtually any shape. The rigid frame member can be omitted and the flexible surround member secure directly to the loudspeaker enclosure. A discrete hinge member can be used in place of or in addition to the integral hinge member.

An auxiliary bass radiator of which the substantially rigid panel member is in the form of an oval with two parallel sides can be provided with a hinge portion along one of the two parallel sides. In that case, the flexible surround member can comprise a semi-circular roll of which the radius is very much reduced along that side constituting the hinge portion. For example, the roll can have a radius of 1 millimetre along the hinge portion side and a radius of 10 millimetres along the other side.

Virtually any construction which constrains the rigid panel member to flap (like the wings of a bird) as opposed to rock (like a cradle) or to move back and forth (like a piston) can be employed in an auxiliary bass radiator according to the invention.

An auxiliary bass radiator unit in accordance with the invention can be made by taking an auxiliary bass radiator unit of conventional form and adding to it a hinge to constrain the rigid panel member to move as a hinged flap.

What is claimed is:

1. An auxiliary bass radiator unit for mounting in an aperture in a loudspeaker enclosure, said unit comprising a substantially rigid panel member mounted on a flexible surround member so as to allow said panel member mounted in said aperture to move in sympathy with sound waves within said enclosure, wherein said panel member is constrained to move as a hinged flap whenever it moves.

2. An auxiliary bass radiator unit as claimed in claim 1, wherein a hinge portion is included within said flexible surround member to mount said panel member for movement as a hinged flap.

3. A unit as claimed in claim 2, wherein the outer periphery of said surround member is connected to a substantially rigid frame member to mount said flexible surround member in said aperture.

4. A unit as claimed in claim 3, wherein said hinge portion is defined by an integral part of said surround member.

5. A unit as claimed in claim 2, wherein said panel member has a plurality of substantially straight sides along one of which said hinge portion is provided.

6. A unit as claimed in claim 5, wherein said panel member is substantially rectangular and has rounded corners at its end opposite to said hinged portion, and a long side of said rectangular panel member has said hinged mounting.

7. A unit as claimed in claim 5, wherein the hinge portion is provided along only the one side.

8. A unit as claimed in claim 2, wherein said hinge portion comprises a flat web portion of said flexible surround member.

9. An auxiliary bass radiator unit for mounting in an aperture in a loudspeaker enclosure, said unit comprising a substantially rigid panel member mounted on a flexible surround member to allow said panel member to move in sympathy with sound waves within said enclosure, and a hinge portion included within said flexible surround member mounting said panel member for movement as a hinged flap.

10. A unit as claimed in claim 9, wherein the outer periphery of said surround member is connected to a substantially rigid frame member for mounting the flexible surround member in the said aperture, and wherein said frame member includes a sealing bead of resilient material to seal said frame member in said aperture.

11. A unit as claimed in claim 9, wherein said panel member includes a substantially straight side along at least part of which said hinge portion is provided, and wherein said hinge portion is defined by an integral part of said surround member.

12. A unit as claimed in claim 11, wherein said surround member has a flat web portion, and said hinge portion comprises said flat web portion of said surround member.

13. A unit as claimed in claim 12, wherein said web portion is connected to an edge portion of said panel member and to a corresponding edge portion of said frame member and further includes an integral spur extending said flat web portion into a T-shaped cross-section, said spur being located between the edge of said panel member and the edge of the frame member.

14. A unit as claimed in claim 11, wherein the hinge portion is provided along only the substantially straight side.

15. A unit as claimed in claim 9, wherein at locations other than in said hinge portion, be said surround member comprises a roll portion.

16. A unit as claimed in claim 15, wherein said roll portion tapers towards said hinge portion, said roll portion is of semi-circular cross-section, and said roll portion includes transverse ribs.

17. A loudspeaker unit comprising:

a loudspeaker enclosure, at least one loudspeaker drive unit mounted in an aperture in said loudspeaker enclosure, at least one auxiliary bass radiator unit mounted in an auxiliary bass radiator aperture in said loudspeaker enclosure, said auxiliary bass radiator unit comprising a substantially rigid panel member mounted on a flexible surround member for movement in sympathy with sound waves within the enclosure, said flexible surround member being mounted in said auxiliary bass radiator aperture, and a hinge portion being included within said flexible surround member mounting said panel member for movement as a hinged flap.

18. A loudspeaker unit as claimed in claim 17, wherein the outer periphery of said surround member is connected to a substantially rigid frame member, said surround member being mounted in said auxiliary bass radiator unit aperture by said substantially rigid frame member.

19. A loudspeaker unit as claimed in claim 18, wherein two of said auxiliary bass radiator units are mounted on opposite sides of said enclosure.

20. A loudspeaker unit as claimed in claim 18, wherein said panel member includes a substantially straight side along at least part of which said hinge portion is provided, said hinge portion being defined by an integral part of the surround member and comprising a flat web portion of the surround member, said web portion being connected to an edge portion of the panel member and to a corresponding edge portion of the frame member and further including an integral spur extending said flat web portion into a T-shaped cross-section, said spur being located between the edge of the panel member and the edge of the frame member.

21. A loudspeaker unit as claimed in claim 18, wherein said surround member comprises a roll portion, said roll portion being of semi-circular cross-section, and including transverse ribs, said ribs being formed by corrugations in the material of said surround member.

22. A loudspeaker unit as claimed in claim 17, wherein said panel member is substantially rectangular with rounded corners at its end opposite to the hinged portion, and a long side of the rectangular panel member has said hinged mounting.

* * * * *